United States Patent [19]

Caccamisi

[11] 4,281,692

[45] Aug. 4, 1981

[54] APPARATUS FOR FILLING LAMPS

[76] Inventor: Michael V. Caccamisi, Rte. 2, Box 698, Garland, Tex. 75040

[21] Appl. No.: 60,923

[22] Filed: Jul. 26, 1979

[51] Int. Cl.[3] ..... B65B 3/06

[52] U.S. Cl. ..... 141/370; 141/95; 141/97

[58] Field of Search ..... 137/377, 382; 141/51, 141/97, 95, 231, 285, 369, 370, 390, 312, 340; 222/182; 251/293

[56] References Cited

U.S. PATENT DOCUMENTS 516,540 3/1894 Johnson ..... 141/369

*Primary Examiner*—Frederick R. Schmidt

*Attorney, Agent, or Firm*—Thomas L. Cantrell; Joseph H. Schley

[57] ABSTRACT

An apparatus for safely and conveniently filling oil lamps of the kind often used for decorative lighting in restaurants and clubs. It includes a housing proportioned to fit over a lamp to be filled. The upper portion of the housing contains an oil supply tank or reservoir. Extending downwardly from the bottom of the reservoir is an oil delivery line having a valve in it operable from the exterior of the housing. Light means within the housing may be provided, and the housing may be partly or totally transparent. A hose and filling wand may be provided as an alternate means for drawing oil from the reservoir.

7 Claims, 3 Drawing Figures

APPARATUS FOR FILLING LAMPS

BACKGROUND OF THE INVENTION

A common form of decorative lighting for restaurants, clubs, and similar establishments is the use of small individual oil lamps on tables, which when lit provide a candlelike lighting effect without the several disadvantages of traditional candles. Such lamps typically comprise a canlike base which serves as an oil container, and a wick assembly fitted into a centrally located opening in the top of the base, which is also the fill opening when the wick assembly is removed. In addition, such lamps often have a chimney mounted on the base, and perhaps a lampshade carried by the chimney.

Despite their attractiveness and general superiority to candles, decorative oil lamps present a troublesome operating problem to restaruant operators, because they must be refilled with oil on a regular basis, such as weekly. The filling operation either involves gathering all of the lamps from their separate locations on the tables, filling them from a centrally located (and usually large) oil tank, and returning them to the tables after filling, or carrying a small oil container and funnel from table to table to fill the lamps one-by-one at the tables. Either method is tedious, involves a repeated risk of spillage, and a certain degree of danger. The general level of lighting in many restaurants is deliberately made low, and this means that the second method involves working in semi-darkness, which aggravates the problems inherent in it.

SUMMARY OF THE INVENTION

In accordance with the present invention, an apparatus is provided for greatly facilitating the task of filling small oil lamps of the kind often used for decorative lighting in restaurants, clubs, and similar establishments. The apparatus includes a housing having three functionally distinct zones arranged vertically therein.

The lower portion of the housing is one such zone. It is open at the bottom, and its sidewalls are dimensioned to surround the base, or oil container, of a lamp to be filled. When the housing is placed over a lamp base, the base is more or less precisely centered within the housing by reason of the dimensioning of the housing walls.

The uppermost portion of the housing is another such zone and comprises a tank or closed reservoir for holding a supply of lamp oil, usually kerosine or a similar medium gravity oil. The tank is provided with a fill opening equipped with a removable cap.

The middle zone of the housing contains a centrally located oil delivery line extending downwardly from the bottom of the reservoir to a point just short of the top of a lamp base positioned in the lower zone of the housing. By reason of the central location of the oil delivery line, and the centering of the lamp base within the housing described above, the oil delivery line terminates right at the central fill opening of the lamp base. The oil delivery line is in liquid communication with the interior of the oil supply reservoir above it, and is open at its lower end. It contains a valve which is biased to normally close the line, and the valve operating means extends laterally to the wall of the housing so it may be operated from outside the housing to open the valve.

The apparatus is operated by first placing a supply of oil in the reservoir. The housing is then placed over a lamp base whose wick assembly has been removed so that the fill opening is open, and the valve actuator is operated to open the valve to allow oil to run from the reservoir through the delivery line and into the lamp base.

The housing may desirably be constructed partly or entirely of transparent meterials, and may have openings in the walls of the lower and middle zones thereof, both of which arrangements facilitate observation of the filling operation. In addition, a battery operated lamp may be mounted in the middle zone of the housing to provide illumination.

In an alternate form a flexible oil delivery line with a valve-equipped wand may be provided for filling lamp bases positioned outside of the housing, either through their central fill openings or through a specially fitted fill valve. The flexible oil delivery line may be provided in addition to, or in replacement of, the primary oil delivery line described above.

From the foregoing, it can be seen that a principal object of the present invention is to provide an apparatus for filling lamps which is simply constructed, simple to use, and which greatly facilitates the filling of large groups of oil lamps, a situation commonly encountered in restaurants and similar establishments.

The manner in which this object, together with other objects and purposes, are achieved may best be understood from a detailed consideration which follows, together with the accompanying drawings.

DESCRIPTION OF THE PREFERRED EMBODIMENTS

Figure 1:
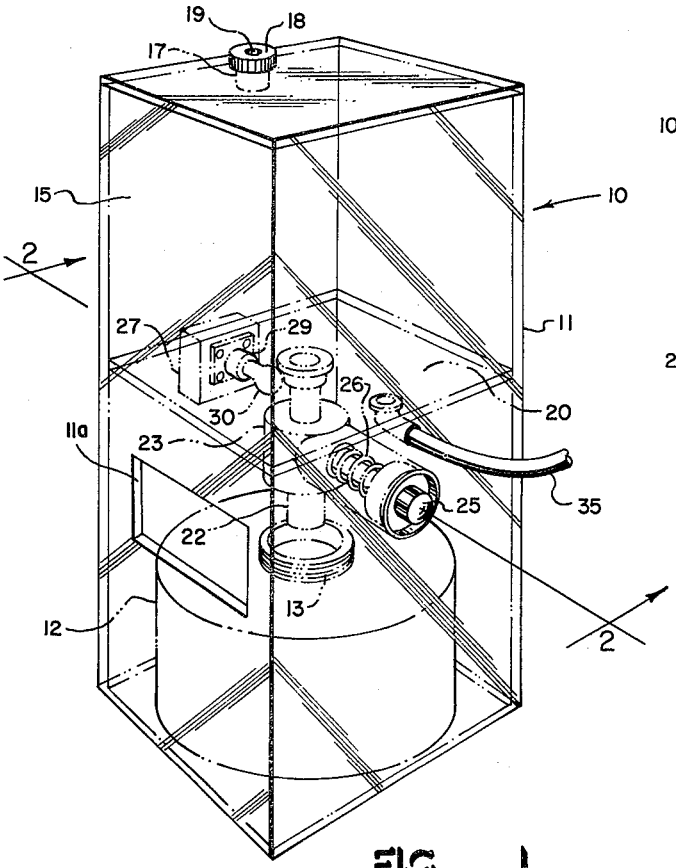
FIG. 1 is a perspective view of an apparatus for filling lamps constructed in accordance with the invention.

In the drawings, the apparatus of the invention is designated generally as 10. The primary structural element of the device is housing 11, which in its preferred form is shaped as an upright rectangular prism constructed of transparent material. The shape of housing 11 may be varied; for example, it may be an upright cylinder. In addition, it is not necessary for the entire structure of the housing to be constructed of transparent materials, although it is much preferred that the lower portion be so constructed, or alternately, that openings such as opening 11*a*, in the sidewalls of the lower portion be provided so that visual access may be had to the interior of the housing. The bottom of housing 11 is open so that it may be placed over a lamp base 12.

Figure 3:
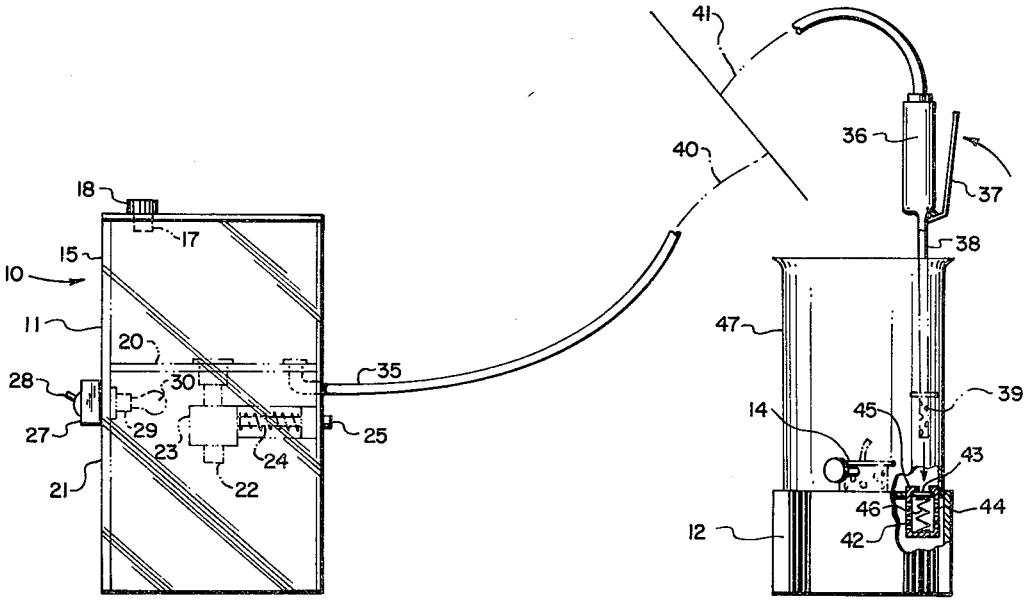
FIG. 3 is a side elevational view on a reduced scale showing the structure and use of the alternate oil delivery line.

Lamp base 12 is a generally cylindrical can-like container with a threaded centrally located fill opening 13 in the top thereof. As can be seen in FIG. 3, a wick assembly 14 is attached to the lamp base at the fill opening.

Figure 2:
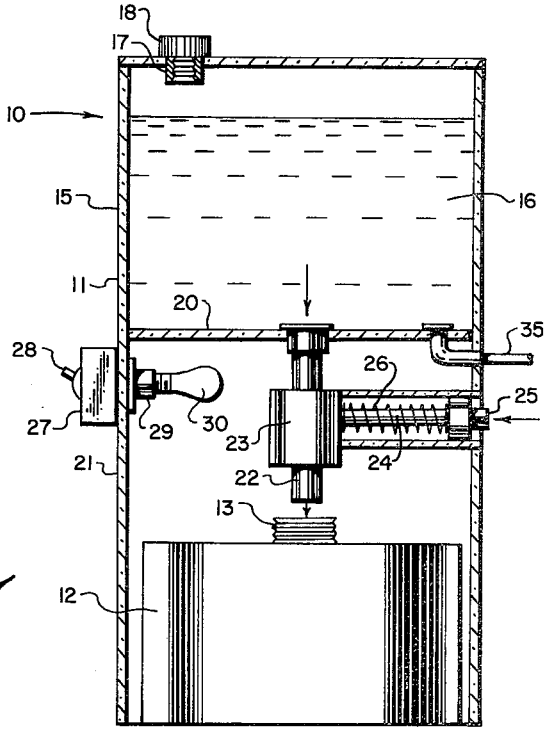
FIG. 2 is a cross-sectional side elevational view of the apparatus of FIG. 1, the section being taken on the line 2—2 of FIG. 1.

As can best be seen in FIGS. 1 and 2, the side walls of housing 11 are proportioned so that the housing fits rather closely over lamp base 12, and the lamp base is substantially centered within the lowermost portion of the housing.

In the uppermost portion or zone of housing 11, oil reservoir 15 is formed, and in use, illuminating oil such as kerosine 16 is placed in the reservoir through fill opening 17, which is provided with a closure 18. The closure has a vent 19 to prevent atmospheric crushing of the housing when kerosine is drawn therefrom in use. In the preferred embodiment, the reservoir 15 is formed by the side and top walls of housing 11 and horizontal partition 20, but other forms of construction may be employed if desired.

For convenience, the portion of the housing lying between reservoir 15 and the lowermost portion which is occupied in use by lamp base 12 is here referred to as middle zone or portion 21. In the middle zone an oil delivery line 22 extends from the center of floor 20 of reservoir 15 to a point just above fill opening 13 of the lamp base. Line 22 is in fluid communication at its upper end with the interior of reseroir 15, and is open at its lower end. Mounted in line 22 is valve 23, which has an operating lever 24 extending laterally to an operating button 25 on an exterior wall of housing 11. Spring 26 works against operating button 25 to bias valve 23 to a normally closed position. Operating button 25 is depressed or pushed inwardly to open valve 23 to permit kerosine 16 to flow downwardly through line 22 into lamp base 12.

An electrical housing 27 is mounted on the wall of main housing 11. It carries a switch 28, bulb socket 29, light bulb 30, and an internally mounted battery (not shown). By operating switch 28, bulb 30 may be lighted to provide illumination in the middle and lower zones of housing 11.

In use, reservoir 15 is first filled with kerosine. The lamp base 12 is prepared for filling by removing its wick assembly 14 (see FIG. 3). The housing 11 is placed over lamp base 12, and as explained above, this placement results in the lamp base being centered within the housing with its fill opening aligned with oil delivery line 22. Lamp 30 is turned on if additional illumination is desired. The valve 23 is then opened by depression of valve button 25 and kerosine flows from reservoir 15 into the lamp base. This flow may be observed through a transparent wall of housing 11 and it is terminated by releasing button 25 when observation discloses that the lamp base 12 is substantially full of oil.

An alternate or optional feature of the invention is shown in FIG. 3. A second flexible oil delivery line 35 is fitted into the bottom 20 of reservoir 15 so that it is in fluid communication therewith. Flexible line 35 may be of any convenient length and terminates in a valve housing 36 having an operating lever 37, and a fill lance 38, which is perforated at its end as at 39. For convenience in drawing layout, lamp base 12 and housing 11 are shown as being at the same level, but in actual practice, when flexible fill line 35 is used, the lamp base 12 is positioned at a lower elevation than housing 11 to obtain gravity flow of oil through line 35. This condition is indicated diagrammatically in FIG. 3 by the offset center lines 40 and 41 of delivery line 35. The lower end of lance 38 may be inserted into the fill opening 13 of lamp base 12, or may be inserted into the spring closed valve 42 provided in the top surface of lamp base 12. Valve 42 includes a closure member 43 in a cylindrical valve body 44 which closure member is normally urged against the valve seat 45 by spring 46.

As can be seen from FIG. 3 the use of the lance 38 permits the filling of lamp base 12 without removal of lamp chimney 47. The alternate fill means shown in FIG. 3 as also useful for filling lamp bases which do not fit well within housing 11.

From the foregoing, it can be seen that the present invention provides a simple and effective means for filling oil lamps, and greatly reduces the chances for spillage during such work, which in turn eliminates the dangers and need for clean-up resulting from spillage.

I claim:

1. Apparatus for filling oil lamps of the kind having an oil supply container with a centrally positioned fill opening in the top thereof comprising:

an open-bottomed housing proportioned to be removably fitted over the oil supply container of an oil lamp and to substantially center said container within the confines of said housing;

an oil supply reservoir in said housing above the portion thereof removably confining the oil supply container of said lamp;

an oil delivery line extending from the bottom of said reservoir to the fill opening of the oil supply container of said lamp, said delivery line being in fluid communication with said reservoir, open at its lower end, and further being substantially aligned with the fill opening of said oil supply container at least at lower end of said line;

valve means in said line;

bias means normally urging said valve to a closed position; and valve operating means operable from the exterior of said housing for opening said valve to admit oil from said reservoir to said container.

2. Apparatus in accordance with claim 1 in which at least a portion of said housing is transparent to permit observation of oil flow between said line and said container.

3. Apparatus in accordance with claim 1 in which said housing has an opening therein to permit observation of oil flow between said line and said container.

4. Apparatus in accordance with claim 1 and further comprising electrical illuminating means in said housing beneath said reservoir but above said container confined therein.

5. Apparatus in accordance with claim 1 and further comprising a second, flexible, oil delivery line connected in fluid communication with the bottom of said reservoir, said second line extending exteriorly of said housing and having valve means mounted therein and terminating in a fill lance.

6. Apparatus in accordance with claim 1 in which said housing is an upright rectangular prism.

7. Apparatus in accordance with claim 1 in which said housing is transparent throughout.

* * * * *